United States Patent [19]

Russo

[11] 3,982,296

[45] Sept. 28, 1976

[54] HAIR BRUSH AND COMB CLEANING APPARATUS

[76] Inventor: Doris A. Russo, 24 W. Hill Drive, Los Gatos, Calif. 95030

[22] Filed: Feb. 18, 1975

[21] Appl. No.: 550,843

Related U.S. Application Data

[62] Division of Ser. No. 376,629, July 5, 1973, Pat. No. 3,879,787.

[52] U.S. Cl. ..... 15/38; 15/39

[51] Int. Cl.[2] ..... A46B 13/04; A45D 24/40

[58] Field of Search ..... 15/38, 39; 134/105, 134/200

[56] References Cited

UNITED STATES PATENTS

| | | | |
|---|---|---|---|
| 2,082,991 | 6/1937 | Turco | 15/39 |
| 3,225,377 | 12/1965 | Winter et al. | 15/38 X |
| 3,377,646 | 4/1968 | Von Werder | 15/39 |

*Primary Examiner*—Edward L. Roberts
*Attorney, Agent, or Firm*—John J. Leavitt

[57] ABSTRACT

Presented is a mechanized apparatus for use in commercial establishments such as beauty parlors and barber shops for cleaning and disinfecting hair brushes and hair combs.

3 Claims, 11 Drawing Figures

FIG. 1

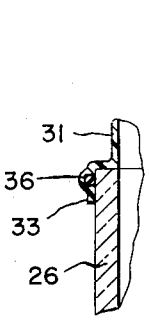
FIG. 10
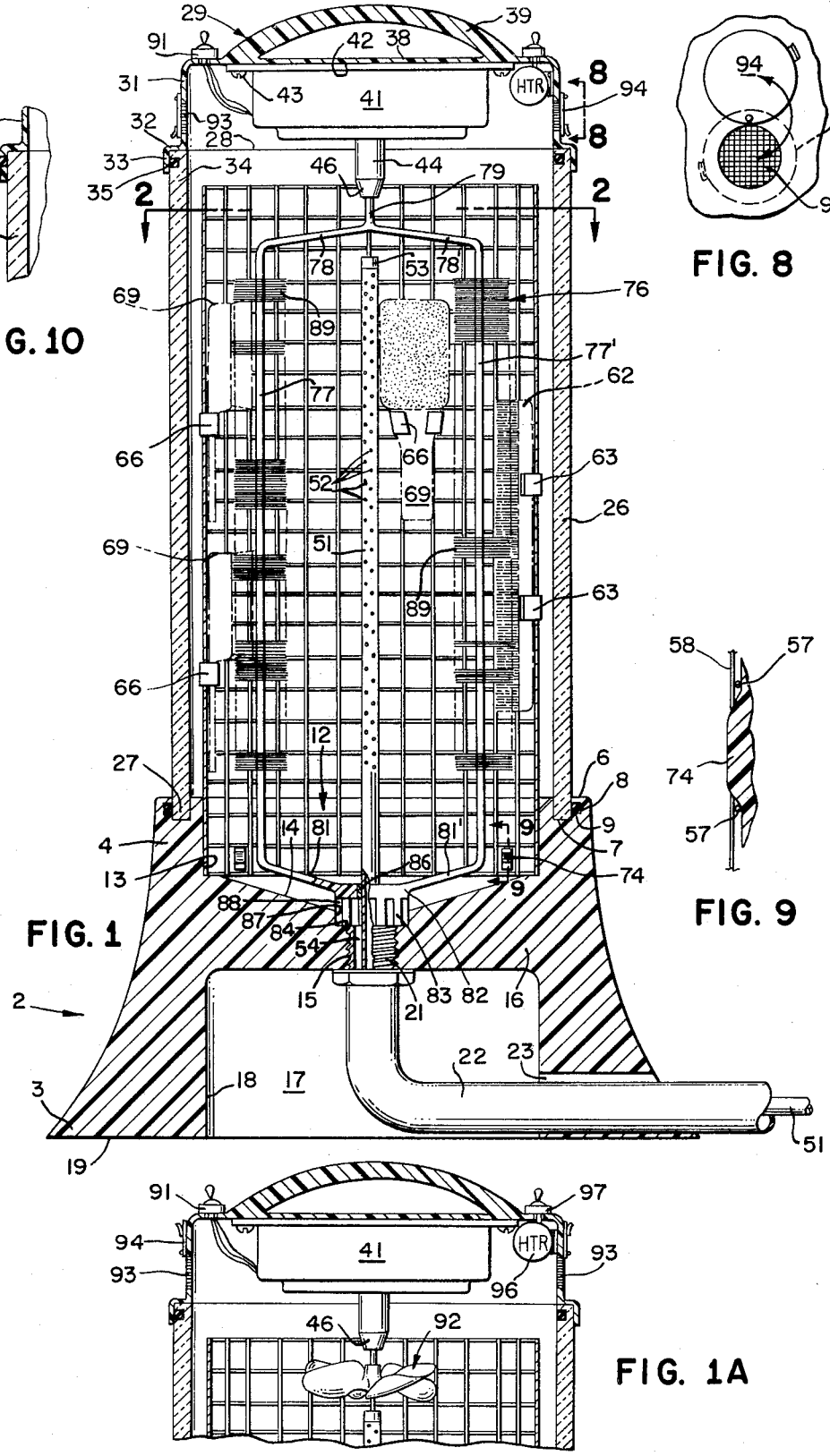
FIG. 1
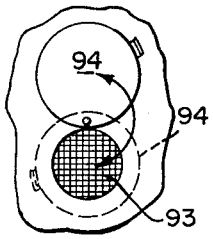
FIG. 8
FIG. 9
FIG. 1A

HAIR BRUSH AND COMB CLEANING APPARATUS

This is a division of application Ser. No. 376,629, filed July 5, 1973, now U.S. Pat. No. 4,879,787.

BACKGROUND OF THE INVENTION

It has always been a problem in commercial establishments, as it has been in private homes, to maintain in a wholesome and aseptic condition, the tools used for grooming the hair. It is well known that hair contains a certain amount of natural body oils which contaminate a brush or comb as soon as it is drawn through the hair. Additionally, many individuals have scalp conditions that are contagious, and it is of course desirable, and in some states, it is mandatory by law, to disinfect a brush or comb between uses with different customers. Accordingly, it is one of the important objects of the present invention to provide a mechanized apparatus for effectively cleaning hair brushes and hair combs.

One of the problems encountered in cleaning hair brushes and hair combs is that contaminating materials tend to cling to the bristles of the brush and to the tines of the comb. It has been found that to effectively clean brushes and combs it is necessary to dislodge such material that has adhered to the brush or comb. Accordingly, another object of the present invention is to provide a mechanized brush or comb cleaner which utilizes a rotary brush element in conjunction with the disinfecting solution to effect scrubbing of the brushes and combs to dislodge any material that has adhered thereto.

To effectively clean a hair brush or hair comb, it is not enough that the material that has adhered to the bristles of the brush and to the tines of the comb be dislodged and removed. Additionally, the surfaces from which the material has been removed should be disinfected to insure that the next customer will not be contaminated. Accordingly, another object of the invention is to provide a mechanized comb or brush cleaner which physically removes adherent material from the bristles of the brush and the tines of the comb and simultaneously disinfects the brush or comb.

The conventional way of cleaning and disinfecting hair brushes and combs in beauty parlors is to first remove by hand the hair that gets entangled in the tines and bristles, then immerse the brushes and combs in a disinfecting solution, where they are left for an indefinite period of time. When removed from the solution, the operator is faced with the necessity of drying the brushes and combs and this can be a time consuming and messy operation. Accordingly, another object of the invention is the provision of a mechanized hair brush and hair comb cleaner which incorporates provisions for drying the hair brushes and combs after they have been cleaned and disinfected.

Conventionally, the cleaning operation for hair brushes and hair combs in beauty parlors is carried out in a back room out of sight of the customers. As a result, it is understood that customers frequently raise the question of cleanliness of the tool and ask pointedly whether the tools have been disinfected. Accordingly, it is a still further object of the invention to provide a mechanized apparatus which is attractive in appearance, and which may be mounted and used in close proximity to the work station of a beauty parlor operator so that a customer may see that the tools used by the beautician are cleaned, disinfected and dried before use, thus increasing the confidence of the customer in the cleanliness of the shop.

The invention possesses other objects and features of advantage, some of which, with the foregoing, will be apparent from the following description and the drawings. It is to be understood however that the invention is not limited to the embodiment illustrated and described, as it may be embodied in various forms within the scope of the appended claims.

BRIEF SUMMARY OF THE INVENTION

In terms of broad inclusion, the hair brush and comb cleaning apparatus of the invention comprises a base on which is mounted an elongated tubular transparent container. Within the container is provided a removable rack on which may be mounted a multiplicity of hair brushes and hair combs. Mounted on the end of the transparent container is a lid structure embodying an electrically driven motor having a shaft that depends concentrically into the transparent container. Mounted on the shaft and rotatable therewith are means for applying an abrading action on the associated hair brushes and hair combs. The abrading means may conveniently be a stiff bristled brush. To disinfect the hair brushes and hair combs supported within the container, a disinfecting medium in liquid form may be piped through the base structure and dispensed under pressure against the brushes and combs, the fluid being contained against spattering by the transparent container surrounding the rack on which the brushes and combs are mounted. Alternatively, the motor shaft may be hollow and the disinfecting fluid may be dispensed through the bristles of the abrading means, the disinfecting fluid being pumped under pressure through the abrading means, or centrifical force may be utilized to disseminate the disinfecting fluid in a fine spray over the surfaces of the brushes and combs to be cleaned. Means are provided in connection with the base to drain the disinfecting fluid from the apparatus. Upon completion of the cleaning and disinfecting cycle, means are also provided in conjunction with the motor means for the introduction of air into the container so as to dry the brushes and combs.

DESCRIPTION OF THE DRAWINGS

FIG. 1 is a vertical cross-sectional view taken through the central axis of the apparatus, and showing the apparatus equipped for cleaning and disinfecting.

FIG. 1A is a fragmentary cross-sectional view showing the apparatus equipped for drying.

FIG. 8 is a fragmentary elevational view of port means formed in the cover assembly to control passage of air therethrough, taken in the direction of arrows 8—8 in FIG. 1.

FIG. 9 is a fragmentary sectional view of a lock lug formed in the base and illustrating its interengagement with the detachable rack assembly.

FIG. 10 is a fragmentary sectional view of a modified seal structure for the cover assembly.

DESCRIPTION OF THE PREFERRED EMBODIMENT

Figure 2:
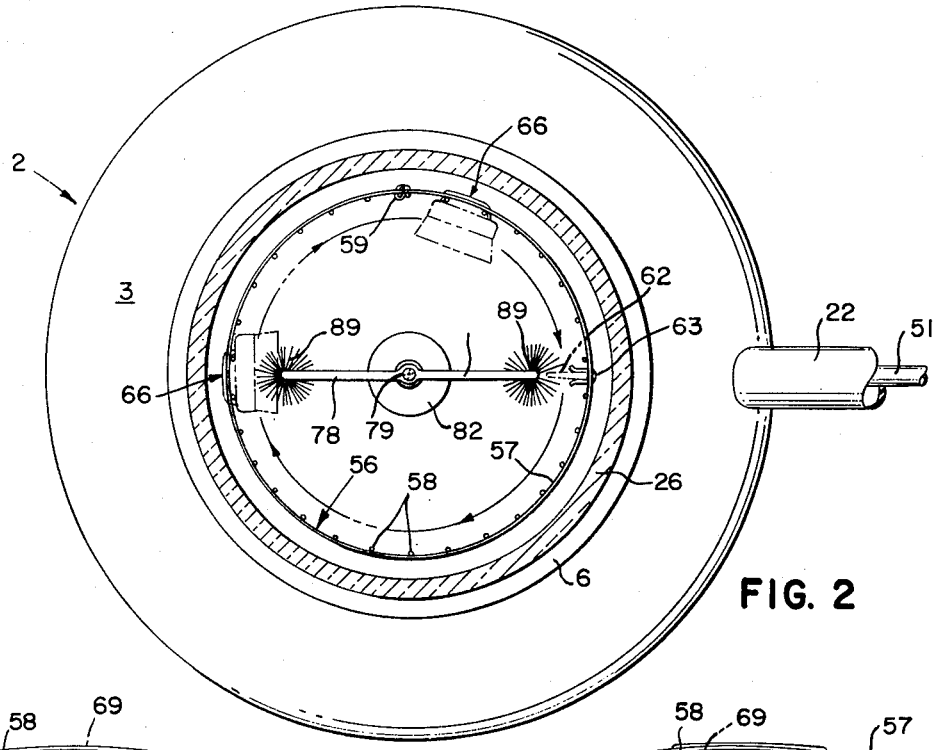
FIG. 2 is a horizontal cross-sectional view taken in the plane indicated by the line 2—2 in FIG. 1.

In terms of greater detail, the mechanized hair brush and hair comb cleaning apparatus of the invention comprises a base designated generally by the numeral 2, having a flared bottom portion 3 to lend stability to the base, and which is adapted to rest on some convenient support such as a sink or vanity top or an appropriate shelf. The upper end portion 4 of the base is provided with a top surface 6 having a circular groove 7 formed therein, the outer wall of which is provided with a radially outwardly extending groove 8 within which is seated an O-ring 9 for purposes which will hereinafter be explained.

Spaced radially inwardly from the circular groove 7 is a recess designated generally by the numeral 12, and having a cylindrical side wall 13 which at its upper end intercepts the top surface 6 of the base, and which at its lower end intercepts a bottom wall 14 which slopes downwardly as shown toward a central opening 15 formed in the radially extending wall portion 16 that separates the recess 12 from a second recess 17 formed from the bottom end of the base and which is provided with cylindrical walls 18 that intercept the lower edge 19 of the base. The bore 15 is preferably threaded internally over a portion of its length to receive a threaded fitting 21 secured on the end of a relatively large diameter hose 22 which passes downwardly through the recess 17 and radially outwardly through an appropriate opening 23 formed in the flared bottom portion of the base member. The hose 22 is provided for a purpose which will hereinafter be explained.

Detachably secured on the base member, and sealingly engaged in the groove 7 formed in the top surface thereof, is a vertically upstanding cylindrical, transparent tubular body 26, preferably fabricated from transparent glass or a synthetic resinous material, the diameter of the tubular transparent body conveniently being approximately 10 to 12 inches, but susceptible of being fabricated larger or smaller. As shown in FIG. 1, a lower end portion 27 of the tubular body is seated in the groove 7 and is sealed therein by the O-ring which circumscribes the outer periphery of the transparent tube.

At its upper end, the tube is provided with an end edge 28 utilized to support the weight of a cover assembly designated generally by the numeral 29. The cover assembly includes a cylindrical shell portion 31 integral with a radially extending rim portion 32 which in turn is integral with a cylindrical flange 33 which circumscribes the upper end portion 34 of the transparent body 26. It will thus be seen that the cover assembly is prevented from transverse shifting in relation to the supporting transparent tube, and the union of cover assembly to transparent tube is sealed fluid tight by the O-ring 35. Where desirable, the flange 33 may be formed with a circular groove 36 within which may be seated the O ring so as to seal the joint between the cover assembly 29 and the transparent tube on which it is supported in the same manner that the lower end of the transparent tube 26 is sealed to the base structure. This construction is illustrated in FIG. 10.

The cover assembly also includes a top plate portion 38 which extends transversely across the top of the tube and is spaced therefrom in a parallel relationship to the top edge 28. Handle means 39 are provided on the top plate portion 38 so that the cover assembly may be easily removed when necessary. In the embodiment illustrated the cover assembly is shown made from plastic, but it should be understood that the cover assembly may be fabricated from other materials, such as metal.

The cover assembly performs at least two separate functions. First, it closes the upper end of the transparent tube 26 to prevent the escape therefrom of vapor or moisture during the operation of the device, and secondly, it forms a convenient support for an electrically driven motor 41 suitably attached to the inner surface 42 of the cover assembly by appropriate screws 43. The motor is provided with a drive shaft 44 on which may be mounted a chuck 46 of the type that is conveniently found on an electric drill motor. The chuck is utilized for the support and rotation of a hair brush and hair comb abrading assembly designated generally by the numeral 47 and a blower assembly designated by the numeral 48 for drying the hair brushes and combs after they have been abraded and disinfected.

To disinfect the hair brushes and hair combs, the apparatus is provided with a centrally disposed conduit 51 having a multiplicity of apertures 52 therein, and sealed at its upper end by a cap 53. At its lower end, the conduit 51 passes downwardly through the aperture 15 formed in the base member 2, and more specifically, passes downwardly through the interior of the drain hose 22, the diameter of the conduit 51 being proportioned to the diameter of the drain hose so that an annular passage 54 is provided between the outer periphery of the conduit 51 and the inner periphery of the drain hose.

Thus, the conduit 51 and the hose 22 are generally concentric, the drain hose 22 terminating in a convenient waste water outlet (not shown) while the conduit 51 at its end remote from the capped end 53 is connected to a source of disinfecting fluid (not shown). It will thus be seen that when a disinfecting fluid from the source of such fluid is pumped through the conduit 51, it sprays radially outwardly through the apertures 52, impinging against whatever brushes and combs are disposed within the large cylindrical and transparent tubular body 26. To maximize the cleaning effectiveness of such disinfecting spray, the combs and hair brushes are retained within the transparent tubular body in a manner which will hereinafter be explained.

Figure 6:
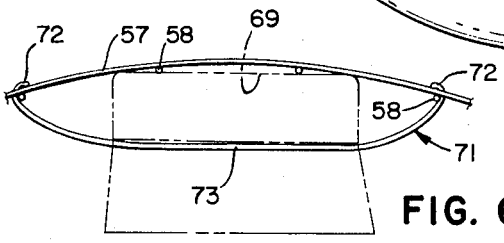
FIG. 6 is a fragmentary elevational view of a second embodiment of a clip for retaining a brush on the rack.
Figure 4:
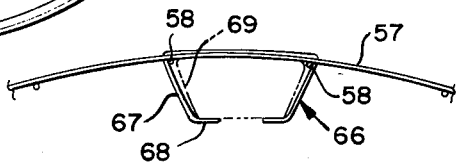
FIG. 4 is a fragmentary view of a portion of the brush and comb retaining rack, and illustrating the manner of attachment of a brush thereto.
Figure 3:
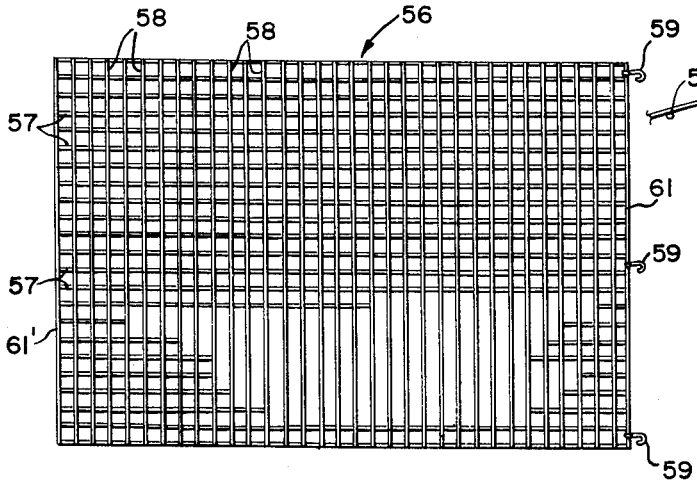
FIG. 3 is a plan view illustrating the brush and comb rack in extended form.
Figure 5:
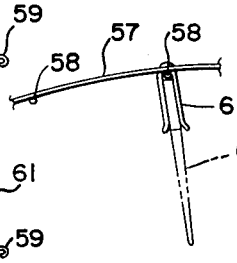
FIG. 5 is a fragmentary elevational view of one embodiment of clip means provided on the rack for retaining a comb.
Figure 7:
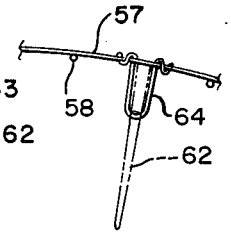
FIG. 7 is a fragmentary elevational view of another embodiment of a clip for retaining a comb on the rack.

Referring to FIGS. 3 through 7, it will there be seen that a rack designated generally by the numeral 56 is provided having longitudinally extending members 57 and vertically extending members 58, the longitudinally extending member 57 circumscribing the vertically extending members and being attached thereto as by spot welding. In some instances it may be possible that the rack 56 will be formed from woven wire cloth so as to minimize the expense of fabrication. Along one end rod 61 of the rack, there are provided hooks 59 which are adapted to engage the opposite end rod 61' of the rack when the rack is formed into a circular configuration as illustrated in plan in FIG. 2. When the rack 56 in its developed form is layed flat as illustrated in FIG. 3, a comb 62 illustrated in broken lines in FIGS. 5 and 7 may be secured to the rack by a clip 63 as illustrated in FIG. 5, or a clip 64 as illustrated in FIG. 7.

The distinction between the clip illustrated in FIG. 5 and that illustrated in FIG. 7 is that the generally U-shaped clip illustrated in FIG. 5 is spot welded or otherwise permanently secured to a vertical member 58 of the rack, whereas the clip 64 illustrated in FIG. 7 is secured to a horizontal or longitudinally extending rod 57 as illustrated.

To secure a brush to the rack, the embodiment illustrated in FIG. 4 illustrates a clip 66 formed from a resilient wire configured to circumscribe a pair of vertically extending rods 58, and having radially inwardly projecting portions 67 each terminating in a flange 68 adapted to circumscribe a portion of the brush handle 69. The brush is thus detachably retained to the rack by the clips 66.

In the embodiment of the clip illustrated in FIG. 6, the brush 69 is retained tightly and resiliently against the horizontal members 57 and the vertical members 58 by an elongated resilient wire clip designated generally by the numeral 71 and having hooked end portions 72 adapted to resiliently engage a vertically extending rod member 58 as shown. The central body portion 73 of the clip 71 extends through the bristles of the brush so as to prevent vertical and transverse displacement of the brush in relation to the rack.

After the combs and brushes have been attached to the detachable rack, the end bar 61 of the rack to which are attached the hooks 59 is brought into juxtaposition with the end rod 61' and the hooks 59 are engaged therewith. The natural resilience of the steel wire from which the rack is formed causes an outwardly biasing force on the rack tending to retain the hooks engaged with the end rod 61', and tending to maintain the circular configuration of the rack after the hoods 59 have been engaged.

In this condition of the rack, i.e., rolled up into cylindriform, the rack with brushes and combs attached is lowered into the interior of the cylindrical transparent tube 26, and forcefully depressed so that the lower end portion of the rack seats firmly but detachably within the recess 12 defined by the side walls 13. This position of the parts is illustrated in FIG. 1. When the rack has been placed in this manner, the side walls 13 of the recess 12 retain the rack in an upright attitude, while rotation of the rack is prevented by engagement of a lug 74 in the space defined between a pair of vertically extending members 58 and a pair of horizontally extending rod members 57. The lug is conveniently molded in and projects from the wall 13 of recess 12 as shown in FIG. 9.

After placement of the rack, it will thus be seen that disinfecting fluid emanating from the apertures 52 will spray on the brushes and combs, causing some disinfecting fluid to adhere thereto, and some to run off into the bottom of the base member. It is desirable that the brushes and combs be abraded to forcefully loosen any solid matter that has adhered thereto so that the disinfecting fluid may wash such solid matter away into the drain tube 22.

The apparatus is therefore provided with an abrading means designated generally by the numeral 76, and comprising a frame having vertical members 77 and 77' diametrically opposed to each other and connected at their upper ends by radial extensions 78 and 78', both of which terminate in a vertically extending shaft portion 79 adapted to be detachably caught in the chuck 46 to effect rotation of the abrading means 76 about the rotational axis of the motor 41.

At its lower end, the frame members 77 and 77' are connected by radially inwardly extending spoke members 81 and 81' with a centrally disposed bearing 82 having downwardly depending spaced lugs 83 the lower end portions of which are rotatably disposed in the upper end of the aperture 15 which has been rabbeted to provide a shoulder 84 on which the lower ends of the spaced lugs 83 abut. The bearing 82 is provided with a central aperture 86 to rotatably receive the conduit 51, while the external surfaces of the lugs 83 are rotatably journaled in the rabbeted aperture 15 as shown, the wall portion 87 extending above the shoulder 84 serving as a journal for the outer surfaces of the lugs 83. It should be noted that the height of the wall portion 87 is proportioned so that the spaces 88 between the lugs 83 project above the lower wall surface 14 of the recess 12, thus permitting disinfecting fluid and rinse water which does not cling to the combs or brushes to pass through the spaces 88 between the lugs 83 and into the interior of the drain hose and out into a waste water receptacle or appropriate drain.

To effect abrading of the combs and brushes suspended on the rack within the tubular shell 26, each of the upright members 77 and 77' is provided with a brush member 89 as shown, each brush member having bristles that extend radially outwardly into impringing contact with the bristles of hair brushes fastened to the rack and with the tines of combs fastened to the rack as illustrated in the FIGS. 1 and 2.

From the foregoing it will be seen that all that is required to clean and disinfect brushes and combs after they have been fastened to the rack 56 and mounted within the shell 26, is to cause the disinfecting fluid to flow into the device by turning on a three way valve and pump (not shown) and by manipulating the switch 91 found on the cover assembly 29 so as to energize the motor 41. This will cause the abrading assembly 76 to rotate within the rack assembly, bringing the bristles 89 of the brushes supported on vertical members 77 and 77' into impinging contact with the bristles and tines of brushes or combs supported on the rack. It should be understood that during this cleaning and abrading operation, solid material and excess fluid will run down and out of the apparatus through the base member.

After such a cleaning and disinfecting operation, it is desirable that the combs and brushes be rinsed and dried. For this purpose, through manipulation of the appropriate three way valve (not shown), the conduit 51 may be disconnected from the source of disinfecting fluid and connected to a source of fresh water which is then caused to be sprayed into the interior of the transparent tube 26 in place of the disinfecting fluid. As with the disinfecting fluid, the rinse fluid passes out of the apparatus through the drain tube 22.

Following such rinsing operation, the cover assembly 29 is removed from the transparent shell 26, drawing the abrading means 76 with it since it is attached to the chuck 46 through the shaft portion 79. After loosening the chuck 46, the abrading means 76 is removed, and in its place there is fastened to the chuck 46 an impeller 92 illustrated in FIG. 1A. To augment the drying operation, apertures 93 are provided in the wall 31 of the cover assembly, each of the apertures being closable by a circular disc or closure plate 94 as shown in FIGS. 1A and 8. In FIG. 1 the closure plates 94 are shown in closed position so as to prevent the escape of any vapors or fluids, while in FIGS. 1A and 8, the apertures are shown opened by pivoting of the closure plate 94 into its upper position as illustrated. With the cover assembly replaced over the open upper end of the hollow body, now equipped with the impeller, air at ambient temperature is drawn into the interior of the cover assembly and circulates through the interior of the tubular transparent shell 26 to dry the brushes and combs. To augment the drying function, an electric heating element 96 is provided within the cover assembly adapted to be energized by an electric switch 97. Thus, the air being admitted to the interior of the cover assembly is heated to augment the drying operation.

It should be understood that while the foregoing structure illustrates and exemplifies an operable hair brush and hair comb cleaning apparatus, embodying certain features that must be attended by the operator, the apparatus can be constructed with an automatic timer in which the different functions to be performed may be performed automatically through the use of appropriate solenoid actuated valves and switches.

Having thus described the invention, what is claimed to be novel and sought to be protected by letters patent is as follows:

1. A hair brush and comb cleaning and disinfecting apparatus, comprising:

a. a base member;

b. a hollow body sealingly supported on the base member and within which brushes and combs to be cleaned and disinfected are adapted to be supported;

c. a cover assembly closing the end of the hollow body remote from the base member to prevent the escape of cleaning and disinfecting fluids from said hollow body;

d. fluid delivery means projecting into said hollow body and adapted to disperse a cleaning and disinfecting fluid radially outwardly onto the brushes and combs to be cleaned;

e. rack means within said hollow body disposed about said fluid delivery means and on which brushes and combs to be cleaned are adapted to be detachably secured;

f. means associated with said base member for draining said cleaning and disinfecting fluid from the interior of said hollow body; and g. motor means supported on said hollow body, and abrading means depending into said hollow body and adapted for rotation by said motor means to abrade the bristles and tines of brushes and combs supported within the hollow body.

2. A hair brush and comb cleaning and disinfecting apparatus, comprising:

a. a base member;

b. a hollow body sealingly supported on the base member and within which brushes and combs to be cleaned and disinfected are adapted to be supported;

c. a cover assembly closing the end of the hollow body remote from the base member to prevent the escape of cleaning and disinfecting fluids from said hollow body;

d. fluid delivery means projecting into said hollow body and adapted to disperse a cleaning and disinfecting fluid radially outwardly onto the brushes and combs to be cleaned;

e. rack means within said hollow body disposed about said fluid delivery means and on which brushes and combs to be cleaned are adapted to be detachably secured;

f. means associated with said base member for draining said cleaning and disinfecting fluid from the interior of said hollow body; and g. abrading means within said hollow body disposed in association with said rack means and any brushes or combs disposed thereon and operable to abrade the bristles and tines of said brushes and combs simultaneous to the application thereon of said cleaning and disinfecting fluid.

3. The combination according to claim 2, in which said abrading means includes an electric motor disposed on said cover assembly and having a drive shaft extending into said hollow body, a frame adapted to be detachably secured to said drive shaft for rotation therewith, and bristled brush elements mounted on said frame and arranged to impinge on a hair brush or comb supported on said rack.

* * * * *